US006557615B2

(12) United States Patent
Smith

(10) Patent No.: US 6,557,615 B2
(45) Date of Patent: May 6, 2003

(54) HORIZONTAL WINDOW BLIND APPARATUS

(75) Inventor: Brian W. Smith, Evansville, WI (US)

(73) Assignee: Advanced Innovations, LLC., Reedsburg, WI (US)

( * ) Notice: Subject to any disclaimer, the term of this patent is extended or adjusted under 35 U.S.C. 154(b) by 0 days.

(21) Appl. No.: 09/977,447

(22) Filed: Oct. 15, 2001

(65) Prior Publication Data

US 2002/0079065 A1 Jun. 27, 2002

Related U.S. Application Data

(63) Continuation-in-part of application No. 09/746,991, filed on Dec. 23, 2000, now Pat. No. 6,405,783.

(51) Int. Cl.[7] ..... E06B 9/30

(52) U.S. Cl. ..... 160/176.1 R; 160/178.3

(58) Field of Search ..... 160/168.1 R, 173 R, 160/176.1 R, 178.1 R, 178.3 R, 236, 177 R

(56) References Cited

U.S. PATENT DOCUMENTS 1,590,886 A * 6/1926 Carella
2,133,113 A * 10/1938 Pratt
2,413,464 A * 12/1946 Nihon
2,583,449 A * 1/1952 Tarnoff
2,871,935 A * 2/1959 Jenkins et al.
4,356,857 A * 11/1982 Wilson
5,165,459 A * 11/1992 Gaber et al.
6,405,783 B1 * 6/2002 Smith

* cited by examiner

*Primary Examiner*—Blair M. Johnson
(74) *Attorney, Agent, or Firm*—David J. Archer

(57) ABSTRACT

A horizontal window blind apparatus having at least a first and a second slat disposed parallel and spaced relative to each other is disclosed. The apparatus includes a first tab which is secured to the first slat, the first tab defining a first opening and a second opening disposed between the first opening and the first slat. A second tab is secured to the second slat, the second tab being aligned relative to the first tab. The second tab defines a third opening and a fourth opening disposed between the third opening and the second slat. A first elongate control extends through the first and the third openings and a first locking device is provided for selectively locking the first control relative to the first tab. A second locking device is provided for selectively locking the first control relative to the second tab. A second elongate control extends through the second and the fourth openings. A third locking device selectively locks the second control relative to the first tab. Also, a fourth locking device selectively locks the second control relative to the second tab. The arrangement is such that relative movement between the first and second control tilts the slats relative to each other so that the slats move between a first disposition thereof in which the slats are open and a second disposition thereof in which the slats are closed.

16 Claims, 13 Drawing Sheets

HORIZONTAL WINDOW BLIND APPARATUS

CROSS REFERENCE TO RELATED APPLICATION

The subject application is a continuation-in-part of co-pending application U.S. Ser. No. 09/746,991 filed Dec. 23, 2000. All the subject matter of the aforementioned application U.S. Ser. No. 09/746,991, U.S. Pat. No. 6,405,783 is incorporated herein by reference.

BACKGROUND OF THE INVENTION

1. Field of the Invention

The present invention relates to a horizontal window blind apparatus. More specifically, the present invention relates to a horizontal window blind apparatus for selectively controlling light transfer through a window.

2. Information Disclosure Statement

Horizontal window blinds of various sizes are used for covering windows and the like so that when the horizontal window blind is closed, the blind serves as a curtain for screening the window. Typically, the prior art horizontal window blinds have included a cord ladder for supporting each slat of the horizontal window blind. The ladder is supported at the upper end thereof by a frame so that when the ladder is manipulated, the slats are tilted from an open to a closed disposition thereof.

Also, a typical horizontal window blind further includes a lifting cord which passes through an aperture in each of the slats so that when the lifting cord is pulled, each of the slats, starting with the lowermost slat, is raised until all the slats are moved parallel relative to each other in an upward direction for permitting cleaning of the glass window therebehind.

However, because of the location of the ladders and the lifting cord extending through the slats, cleaning of the slats has proved to be a tedious and time consuming chore.

The present invention overcomes the aforementioned problem associated with the prior art horizontal window blind arrangements by having the operating controls located away from the slats so that cleaning of the slats is facilitated.

Also, because of the unique arrangement for supporting the slats according to the present invention, when the slats are closed, the slats will not overlap each other as they do in the prior art arrangements. Therefore, according to the present invention, less slats are required thereby reducing the cost of manufacture thereof.

Additionally, the present invention makes it possible for the slats to be removed for cleaning or for exchanging so that the room decor may be altered.

Furthermore, the present invention provides translucent tapes to control tilting of tabs that support the slats of the horizontal blind apparatus so that when the slats are open, an almost unobstructed view through the window is provided without any interruption by unsightly operating cords.

Therefore, it is a primary feature of the present invention to provide a horizontal window blind apparatus that overcomes the problems associated with the prior art arrangements.

Another feature of the present invention is the provision of a horizontal window blind apparatus that facilitates cleaning of the slats.

A further feature of the present invention is the provision of a horizontal window blind apparatus that reduces the cost of production of such apparatus.

Another feature of the present invention is the provision of a horizontal window blind apparatus that permits removal of individual slats for changing a room decor or for cleaning the slats.

Another feature of the present invention is the provision of a horizontal window blind apparatus that overcomes the problems associated with the prior art operating control cords.

Other features and advantages of the present invention will be readily apparent to those skilled in the art by a consideration of the detailed description of a preferred embodiment of the present invention contained herein.

SUMMARY OF THE INVENTION

The present invention relates to a horizontal window blind apparatus having at least a first and a second slat disposed parallel and spaced relative to each other. The apparatus includes a first tab which is secured to the first slat, the first tab defining a first opening and a second opening disposed between the first opening and the first slat. A second tab is secured to the second slat, the second tab being aligned relative to the first tab. The second tab defines a third opening and a fourth opening disposed between the third opening and the second slat. A first elongate control extends through the first and the third openings and a first locking device is provided for selectively locking the first control relative to the first tab. A second locking device is provided for selectively locking the first control relative to the second tab. A second elongate control extends through the second and the fourth openings. A third locking device selectively locks the second control relative to the first tab. Also, a fourth locking device selectively locks the second control relative to the second tab. The arrangement is such that relative movement between the first and second control tilts the slats relative to each other so that the slats move from a first disposition thereof in which the slats are open to a second disposition thereof in which the slats are closed.

In a more specific embodiment of the present invention, the first opening is a first hole extending through the first tab, the first hole having a first and a second end. Also, the second opening is a second hole extending through the first tab, the second hole having a first and a second extremity.

The first tab further defines a nose which is disposed adjacent to the first end of the first hole and the first tab further defines a further nose which is disposed adjacent to the first extremity of the second hole. The third opening is a third hole extending through the second tab, the third hole having a first and a second end. Additionally, the fourth opening is a fourth hole extending through the second tab, the fourth hole having a first and a second extremity.

Moreover, the second tab further defines a protrusion which is disposed adjacent to the first end of the third hole and the second tab further defines a further protrusion which is disposed adjacent to the first extremity of the fourth hole.

Furthermore, the first control is an elongate tape which is preferably flexible and translucent. In a preferred embodiment of the present invention, the tape is fabricated from a polyester film.

The first locking device includes a first block having a first and a second side, the first side selectively engaging the first control when the first block is wedged into the first opening. Also, the second locking device includes a second block having a first and a second edge, the first edge selectively engaging the first control when the second block is wedged into the third opening. Additionally, the third locking device includes a third block having a first and a second face, the first face selectively engaging the second control when the third block is wedged into the second opening. Also, the fourth locking device includes a fourth block having a first and a second termination, the first termination selectively engaging the second control when the fourth block is wedged into the fourth opening.

In a preferred embodiment of the present invention, the second side of the first block is hingedly secured to the first tab and the second edge of the second block is hingedly secured to the second tab. Additionally, the second face of the third block is hingedly secured to the first tab and the second termination of the fourth block is hingedly secured to the second tab.

Also, the first and third blocks are integrally molded with the first tab and the second and fourth blocks are integrally molded with the second tab.

More specifically, the arrangement is such that the first control is locked relative to the first and second tabs by an interaction between the first side of the first block and the nose and an interaction between the first edge of the second block and the protrusion. The arrangement is also such that the second control is locked relative to the first and second tabs by an interaction between the first face of the third block and the further nose and by an interaction between the first termination of the fourth block and the further protrusion.

Moreover, the first tab includes an extension for securing the first tab to the first slat, the extension defining a socket for the retention therein of the first slat. Also, the second tab includes a further extension for securing the second tab to the second slat. The further extension defines a further socket for the retention therein of the second slat.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Included in such modifications would be the provision of having the slats printed with a picture thereon so that when the slats are tilted to the closed disposition thereof, the picture appears. Also, slots could be provided in place of the holes in the tabs so that if cords were to be used, these cords could be locked in place relative to the respective tabs. Additionally, tabs of various lengths could be provided to accommodate various depth windows.

Throughout the specification the term "horizontal window blind" includes a mini-blind, venetian blind or other type of blind having horizontally disposed slats. Also, included would be blinds having curved slats as described herein and flat slats. Furthermore, the slats would be fabricated from wood, aluminum, PVC or any other suitable type of window blind material.

BRIEF DESCRIPTION OF THE DRAWINGS

Similar reference characters refer to similar parts throughout the various views and embodiments of the present invention.

DETAILED DESCRIPTION OF THE DRAWINGS

Figure 1:
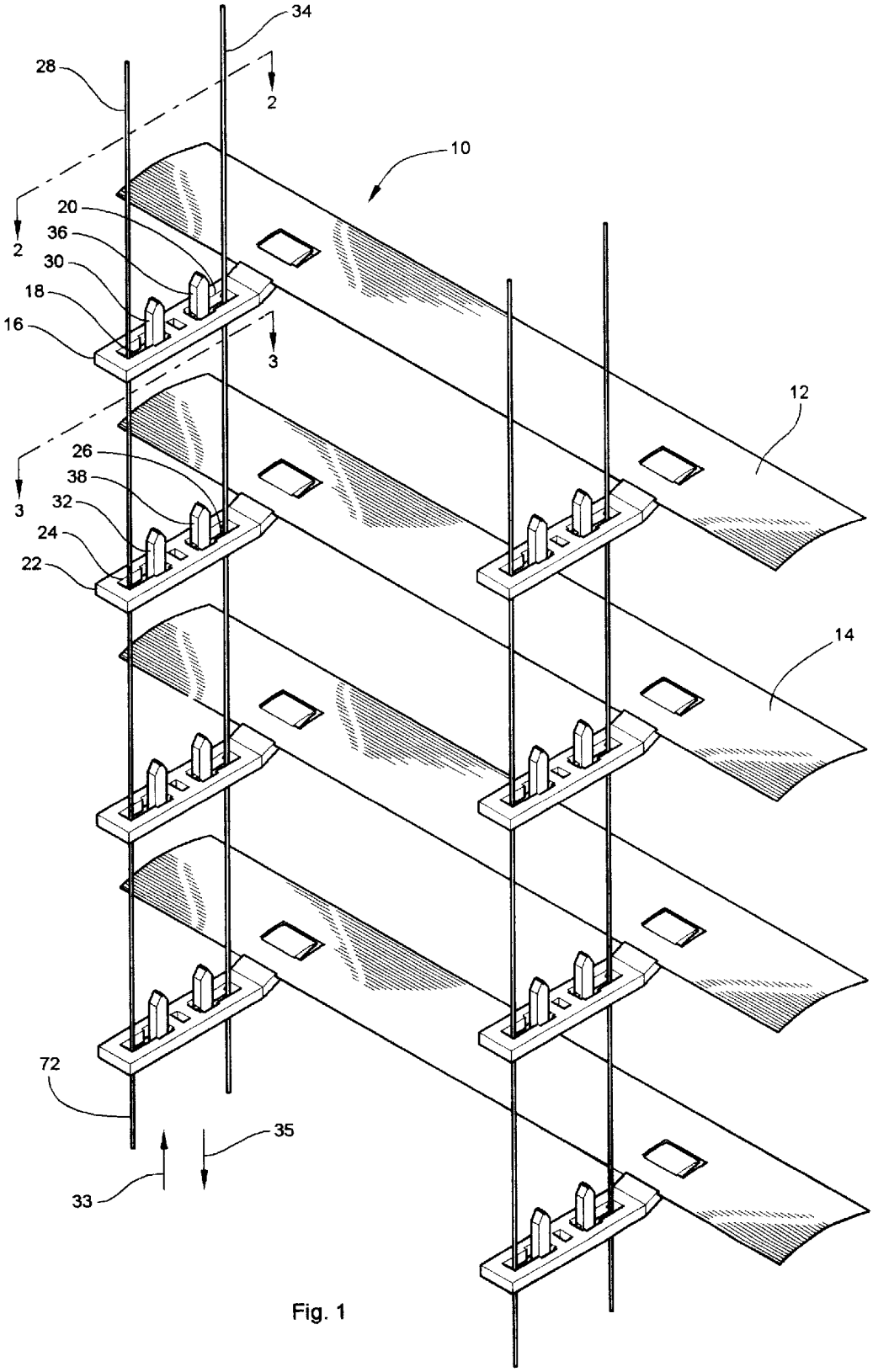
FIG. 1 is a perspective view of a horizontal window blind apparatus according to the present invention.

FIG. 1 is a perspective view of a horizontal window blind apparatus generally designated 10 according to the present invention having at least a first and a second slat 12 and 14 respectively disposed parallel and spaced relative to each other. The apparatus 10 includes a first tab 16 which is secured to the first slat 12, the first tab 16 defining a first opening 18 and a second opening 20 disposed between the first opening 18 and the first slat 12. A second tab 22 is secured to the second slat 14, the second tab 22 being aligned relative to the first tab 16. The second tab 22 defines a third opening 24 and a fourth opening 26 disposed between the third opening 24 and the second slat 14. A first elongate control 28 extends through the first and the third openings 18 and 24 respectively and a first locking device 30 is provided for selectively locking the first control 28 relative to the first tab 16. A second locking device 32 is provided for selectively locking the first control 28 relative to the second tab 22. A second elongate control 34 extends through the second and the fourth openings 20 and 26 respectively. A third locking device 36 selectively locks the second control 34 relative to the first tab 16. Also, a fourth locking device 38 selectively locks the second control 34 relative to the second tab 22. The arrangement is such that relative movement between the first and second control 28 and 34 respectively, as indicated by the arrows 33 and 35 respectively, tilts the slats 12 and 14 respectively relative to each other so that the slats 12 and 14 move from a first disposition thereof in which the slats 12 and 14 are open as shown in FIG. 1 to a second disposition thereof in which the slats 12 and 14 are closed.

Figure 2:
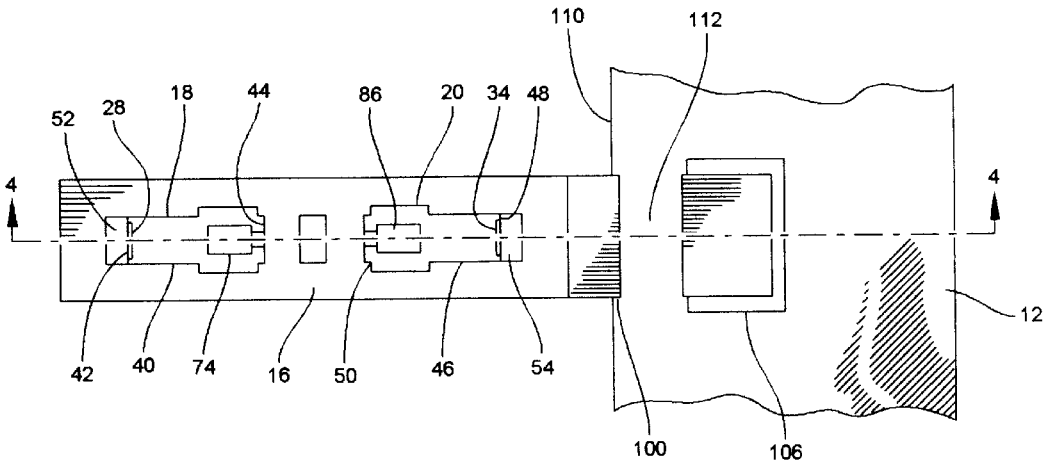
FIG. 2 is a top plan view taken on the line 2—2 of FIG. 1.

FIG. 2 is a top plan view taken on the line 2—2 of FIG. 1. As shown in FIG. 2, the first opening 18 is a first hole 40 extending through the first tab 16, the first hole 40 having a first and a second end 42 and 44 respectively. Also, the second opening 20 is a second hole 46 extending through the first tab 16, the second hole 46 having a first and a second extremity 48 and 50 respectively. The first tab 16 further defines a nose 52 which is disposed adjacent to the first end 42 of the first hole 40 and the first tab 16 further defines a further nose 54 which is disposed adjacent to the first extremity 48 of the second hole 46.

Figure 3:
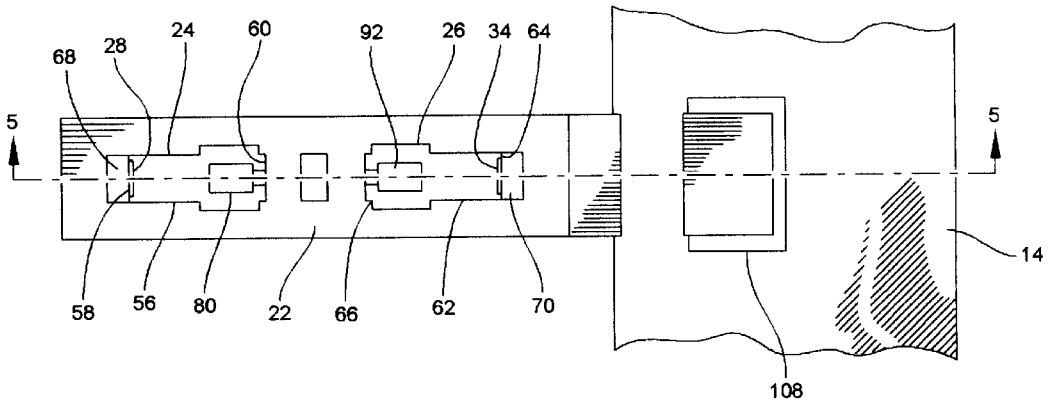
FIG. 3 is a view taken on the line 3—3 of FIG. 1.

FIG. 3 is a view taken on the line 3—3 of FIG. 1. As shown in FIG. 3, the third opening 24 is a third hole 56 extending through the second tab 22, the third hole 56 having a first and a second end 58 and 60 respectively. Additionally, the fourth opening 26 is a fourth hole 62 extending through the second tab 22, the fourth hole 62 having a first and a second extremity 64 and 66 respectively. Moreover, the second tab 22 further defines a protrusion 68 which is disposed adjacent to the first end 58 of the third hole 56 and the second tab 22 further defines a further protrusion 70 which is disposed adjacent to the first extremity 64 of the fourth hole 62.

Furthermore, as shown in FIG. 1, the first control 28 is an elongate tape 72 which is preferably flexible and translucent. The second elongate control 34 is of similar construction to that of the first control 28.

In a preferred embodiment of the present invention, the tape 72 is fabricated from a polyester film.

Figure 4:
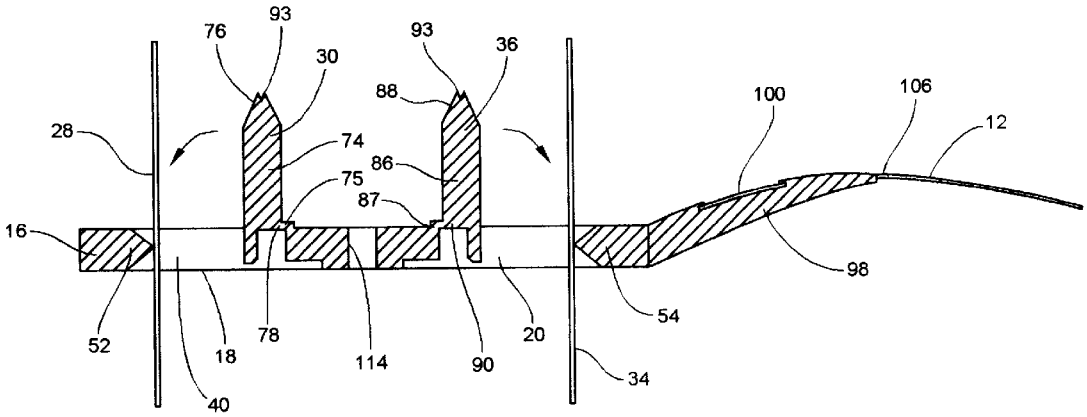
FIG. 4 is a sectional view taken on the line 4—4 of FIG. 2.

FIG. 4 is a sectional view taken on the line 4—4 of FIG. 2. As shown in FIG. 4, the first locking device 30 includes a first block 74 having a first and a second side 76 and 78 respectively, the first side 76 selectively engaging the first control 28 when the first block 74 is wedged into the first opening 18.

Figure 5:
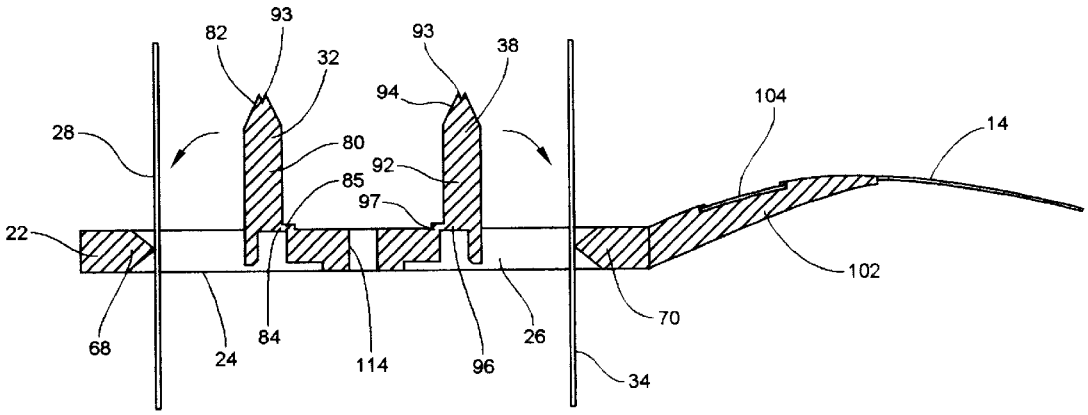
FIG. 5 is a sectional view taken on the line 5—5 of FIG. 3.

FIG. 5 is a sectional view taken on the line 5—5 of FIG. 3. As shown in FIG. 5, the second locking device 32 includes a second block 80 having a first and a second edge 82 and 84 respectively, the first edge 82 selectively engaging the first control 28 when the second block 80 is wedged into the third opening 24.

As shown in FIG. 4, the third locking device 36 includes a third block 86 having a first and a second face 88 and 90 respectively, the first face 88 selectively engaging the second control 34 when the third block 86 is wedged into the second opening 20.

As shown in FIG. 5, the fourth locking device 38 includes a fourth block 92 having a first and a second termination 94 and 96 respectively, the first termination 94 selectively engaging the second control 34 when the fourth block 92 is wedged into the fourth opening 26.

As shown in FIG. 4, in a preferred embodiment of the present invention, the second side 78 of the first block 74 is hingedly secured to the first tab 16 by a hinge 75.

Also, as shown in FIG. 5, the second edge 84 of the second block 80 is hingedly secured to the second tab 22 by a hinge 85.

Additionally, as shown in FIG. 4, the second face 90 of the third block 86 is hingedly secured to the first tab 16 by a hinge 87.

Also, as shown in FIG. 5, the second termination 96 of the fourth block 92 is hingedly secured to the second tab 22 by a hinge 97.

Also, the first and third blocks 74 and 86 respectively are integrally molded with the first tab 16 and the second and fourth blocks 80 and 92 respectively are integrally molded with the second tab 22.

Figure 6:
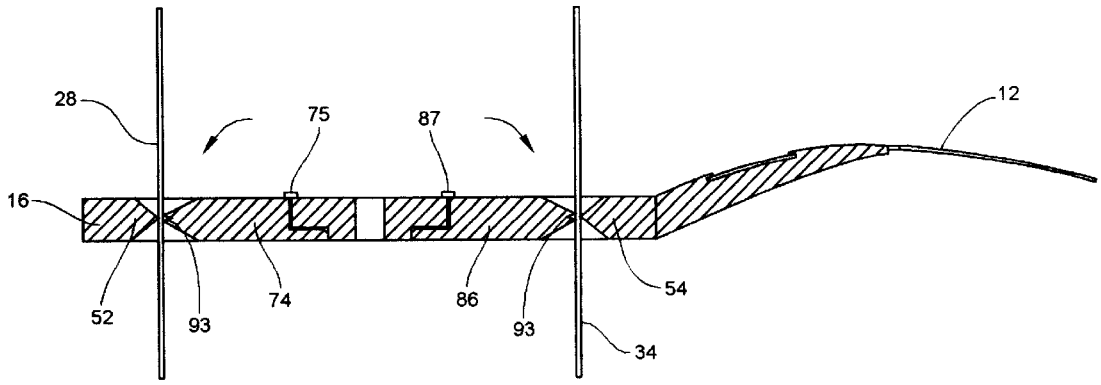
FIG. 6 is a similar view to that shown in FIG. 4 but shows the first and third blocks hinged to the locked dispositions thereof.

FIG. 6 is a similar view to that shown in FIG. 4 but shows the first and third blocks 74 and 86 respectively rotated about hinges 75 and 87 respectively until the blocks 74 and 86 are locked against the nose 52 and further nose 54 respectively with the controls 28 and 34 respectively locked therebetween. More specifically, the arrangement is such that the first control 28 is locked relative to the first and second tabs 16 and 22 respectively by an interaction between the first side 76 of the first block 74 and the nose 52 and an interaction between the first edge 82 of the second block 80 and the protrusion 68. The arrangement is also such that the second control 34 is locked relative to the first and second tabs 16 and 22 respectively by an interaction between the first face 88 of the third block 86 and the further nose 54 and by an interaction between the first termination 94 of the fourth block 92 and the further protrusion 70. More particularly, as shown in FIGS. 4 and 5, a transverse groove 93 is provided in 76, 82, 88 and 94 to assist locking of the blocks relative to the respective noses 52, 54 and protrusions 68 and 70.

Moreover, as shown in FIG. 4, the first tab 16 includes an extension 98 for securing the first tab 16 to the first slat 12, the extension 98 defining a socket 100 for the retention therein of the first slat 12. Also, as shown in FIG. 5, the second tab 22 includes a further extension 102 for securing the second tab 22 to the second slat 14. The further extension 102 defines a further socket 104 for the retention therein of the second slat 14.

As shown in FIGS. 2 and 3 respectively, the first and second slats 12 and 14 respectively are provided with rectangular apertures 106 and 108 respectively so that the edge 110 of the slat 12 can be inserted into the socket 100 and the portion 112 of the slat 12 between the edge 110 and the aperture 106 is able to be snapped into the socket 100 for the retention of the portion 112 within the socket for securing the slat 12 relative to the first tab 16. The second slat 14 is secured to the second tab 22 in the same manner as described relative to the first slat 12. By the aforementioned means, the slats are easily attached to the respective tabs and when a change in decor is required, the slats can easily be removed from the tabs and replaced by slats of a different color.

In operation of the apparatus according to the present invention, the provision of the hinged blocks, 74, 80, 86 and 92 permits easy assembly of the horizontal blind apparatus. Such assembly can either be manual or by means of a machine for positioning of the tabs relative to the controls 28 and 34 and then rotating the respective blocks 74, 80, 86 and 92 to lock the tabs relative to the controls 28 and 34. The slats can be secured to the tabs either before or after the locking process. If the slats are held in the open disposition thereof by a jig, the tabs can then be secured to the slats with for example two spaced apart tabs being secured to each slat. With all the tabs in place, the first and second controls 28 and 34 respectively can then be threaded through the respective holes 40, 46, 56 and 62 and the blocks rotated to lock the tabs 16 and 22 relative to the control tapes 28 and 34. Each of the tabs 16 and 22 is also provided with a central hole 114 as shown in FIG. 4, between the first and second controls 28 and 34 for the passage therethrough of a third tape (not shown) for lifting all of the slats starting from the bottom slat.

When the controls 28 and 34 are fabricated from translucent tape, the apparatus according to the present invention overcomes the problems associated with the prior art unsightly and bulky operating cords.

Figure 7:
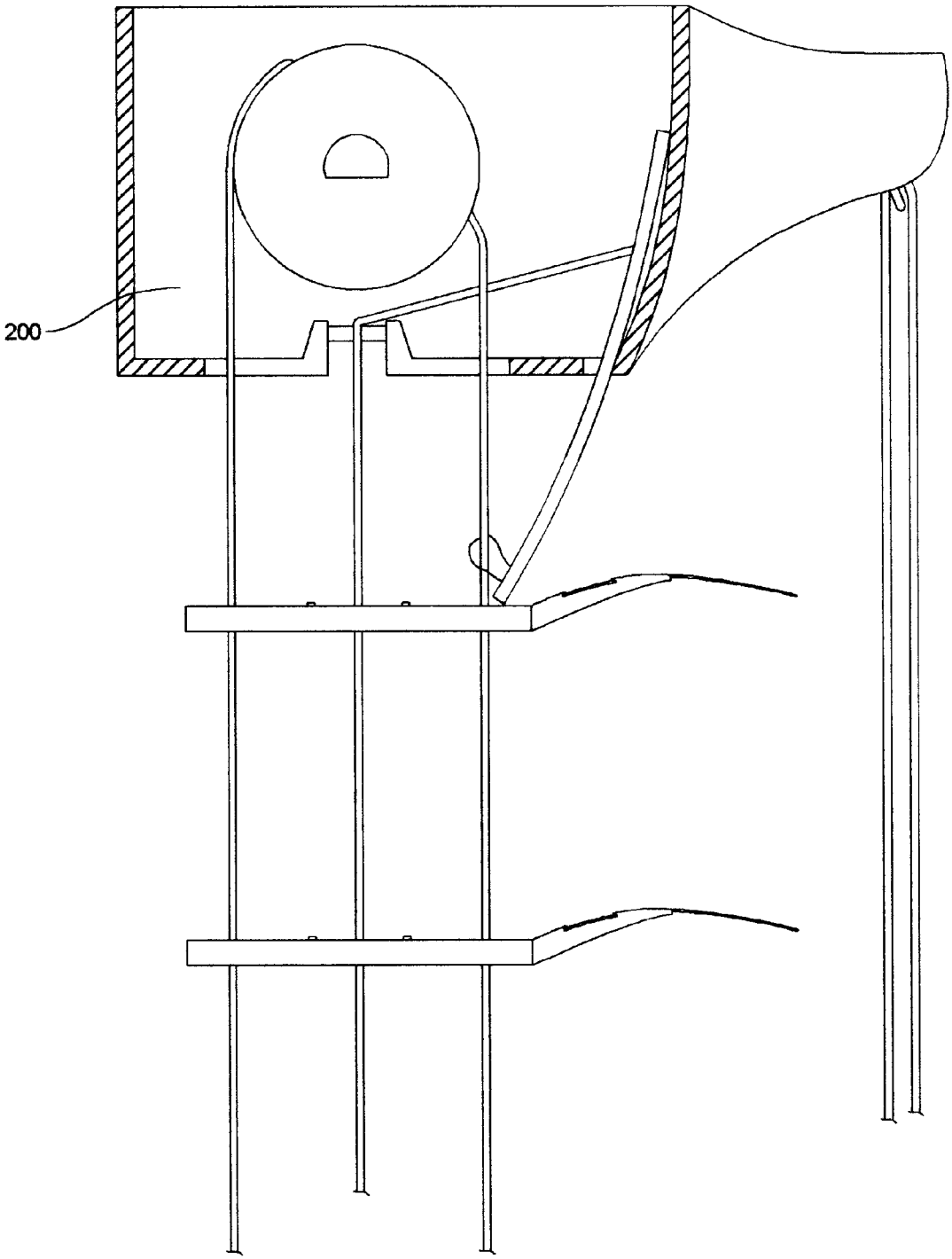
FIG. 7 is a sectional view of a header for the window blind apparatus shown in FIG. 1.
Figure 7A:
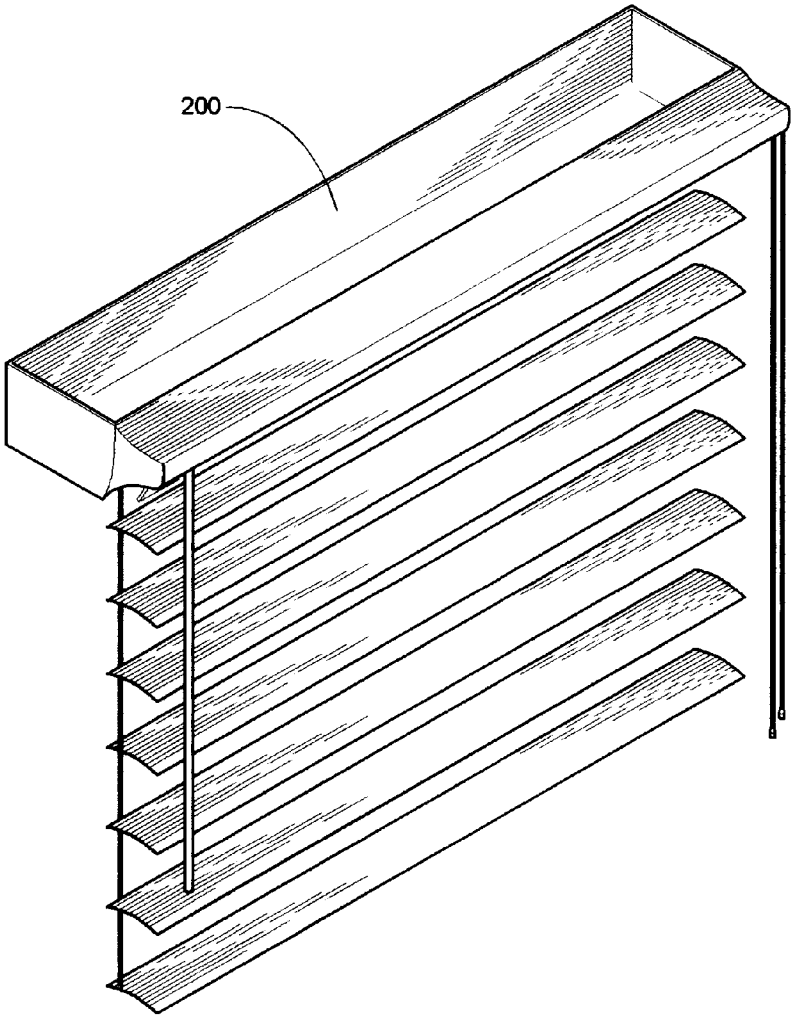
FIG. 7*a* is a perspective view, on a reduced scale, of the header shown in FIG. 7.
Figure 8:
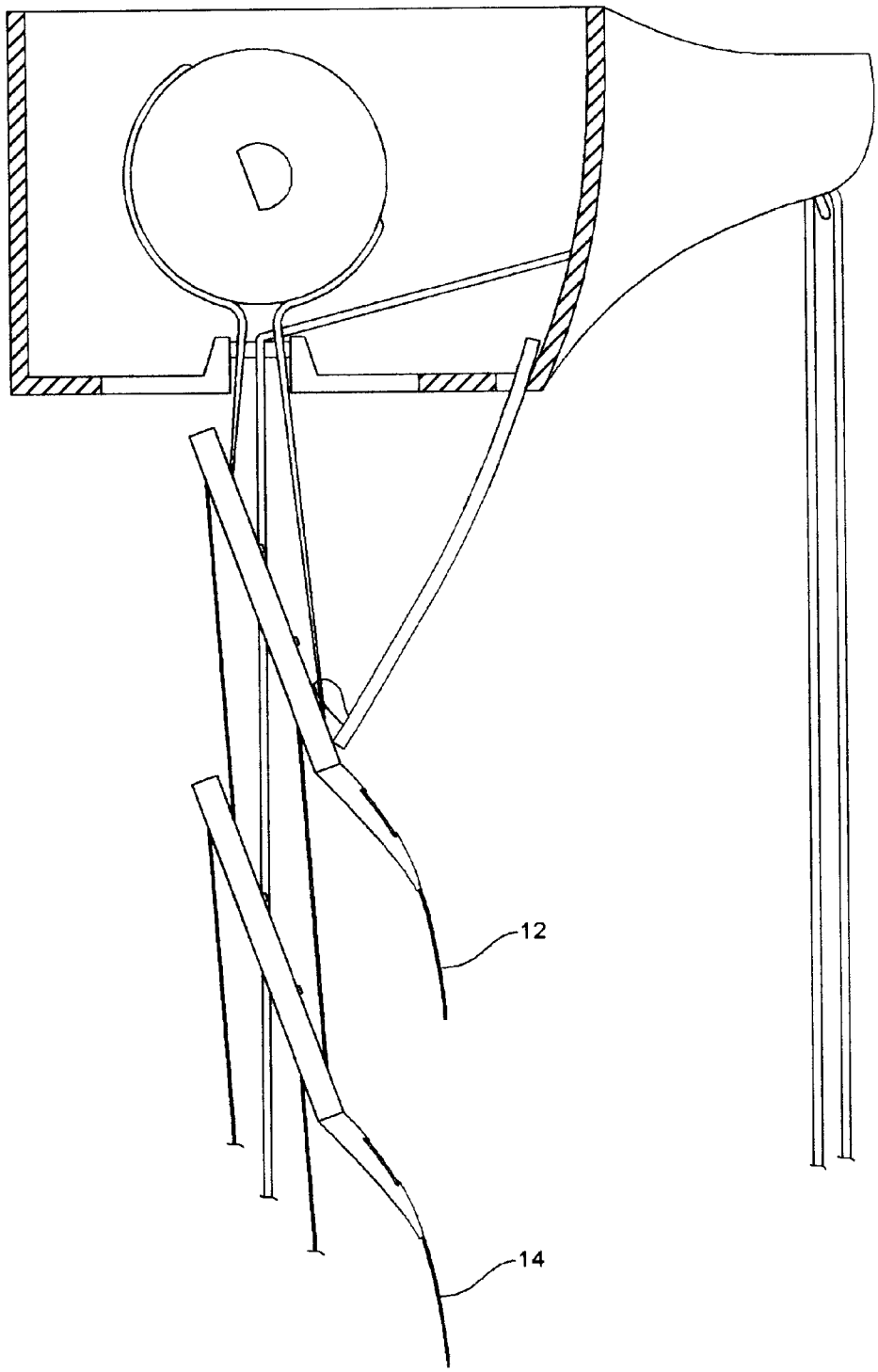
FIG. 8 is a similar view to that shown in FIG. 7 but showing the slats closed.
Figure 9:
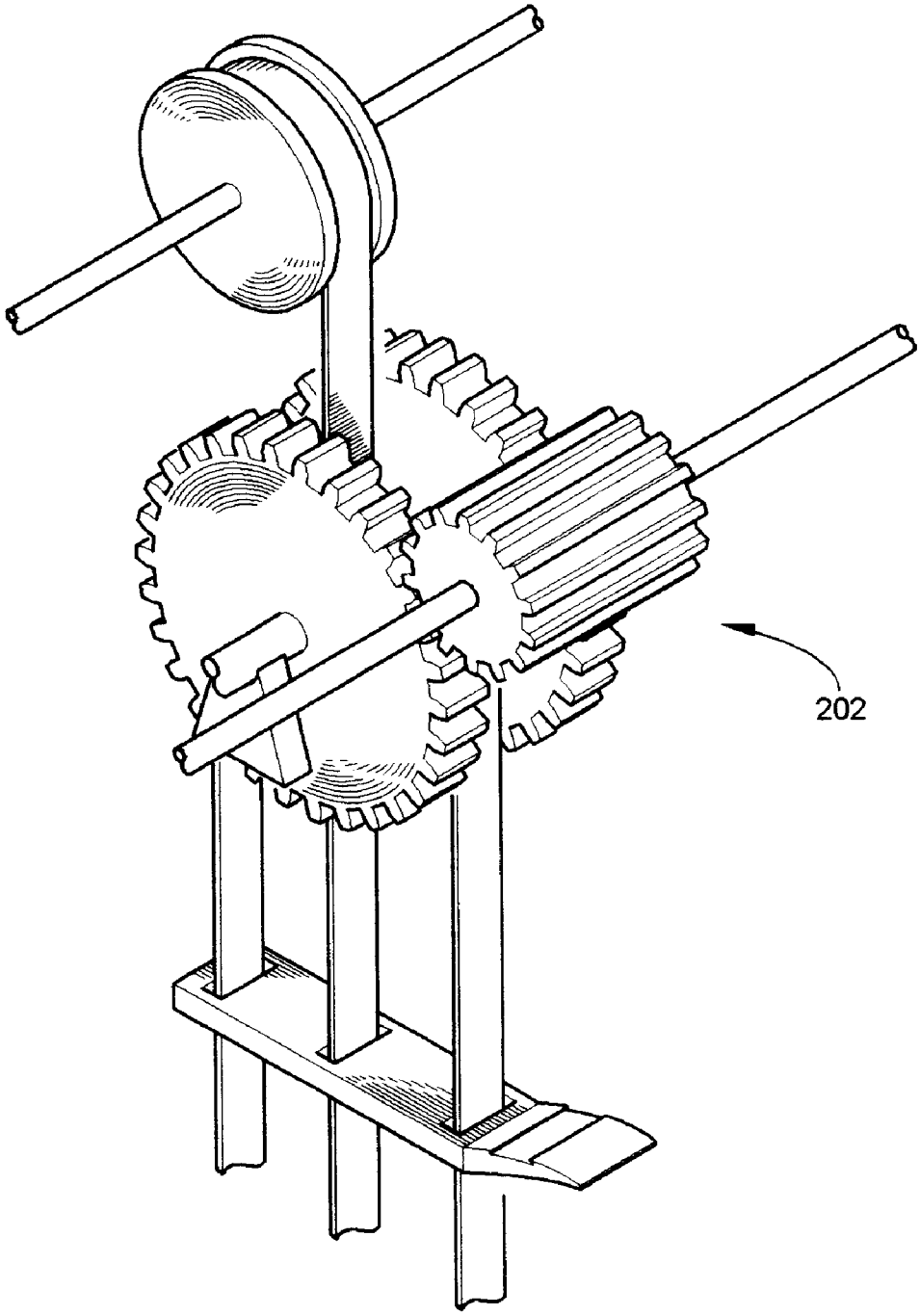
FIG. 9 is a perspective view of a mechanism for lifting and adjusting the window blind apparatus according to the present invention.
Figure 10:
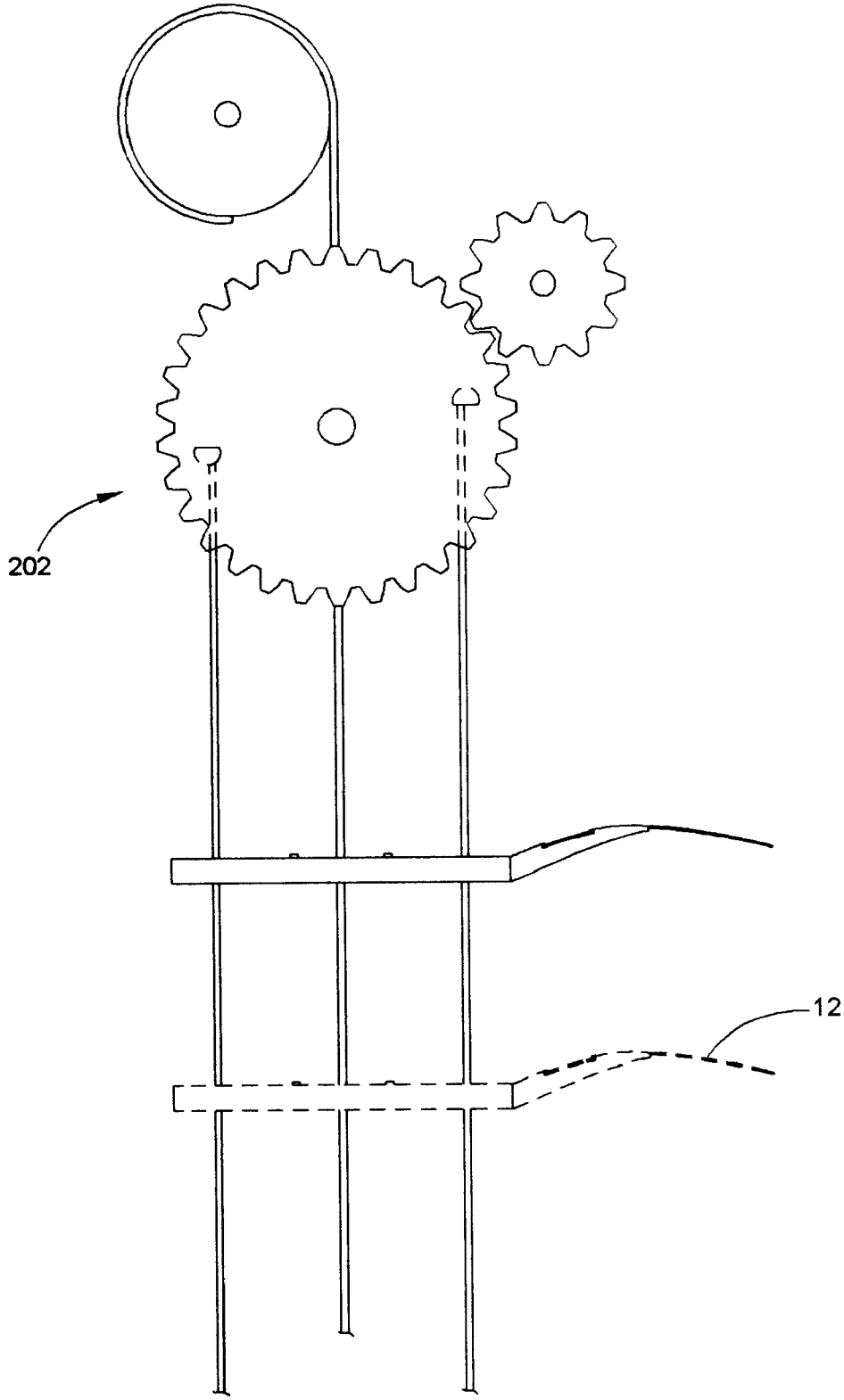
FIG. 10 is a side elevational view of the mechanism shown in FIG. 9 with the slats open.
Figure 11:
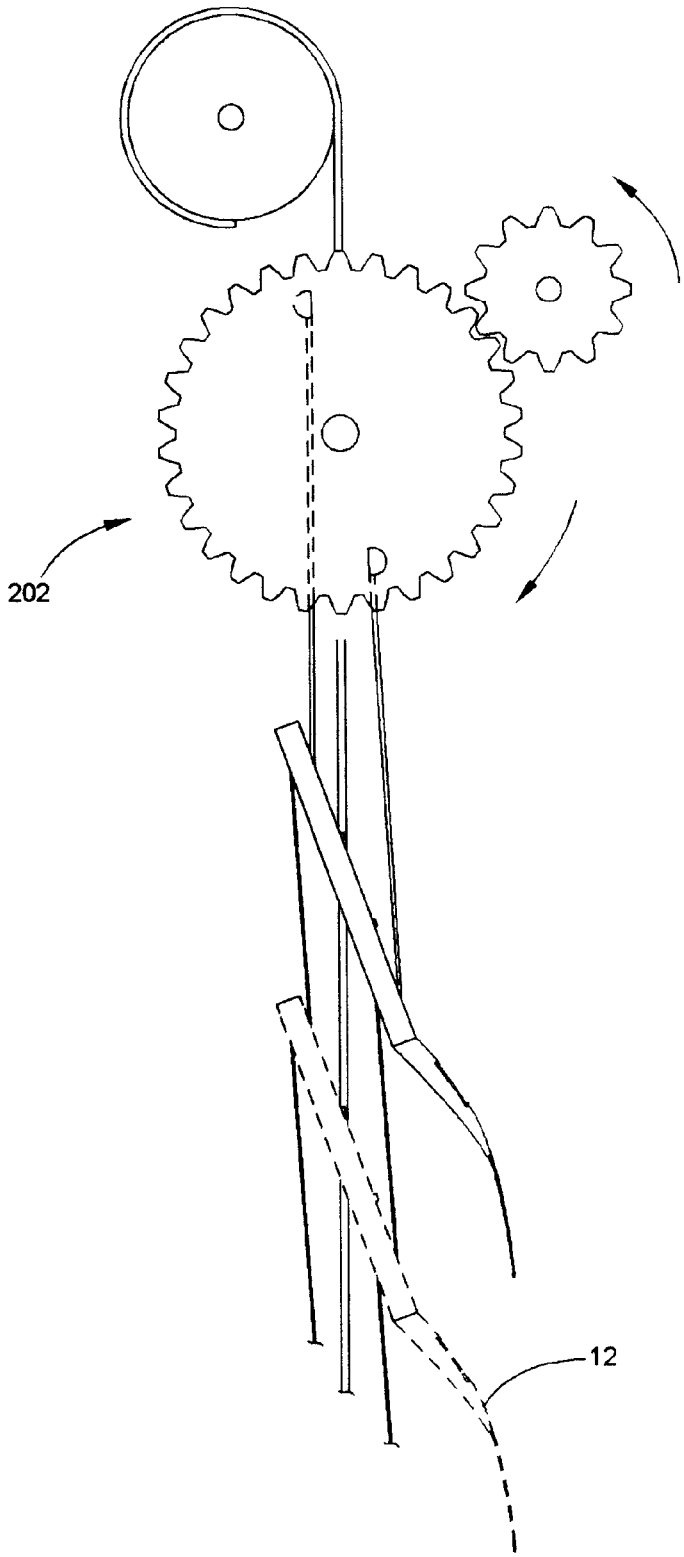
FIG. 11 is a similar view to that shown in FIG. 10 but with the slats closed.
Figure 12:
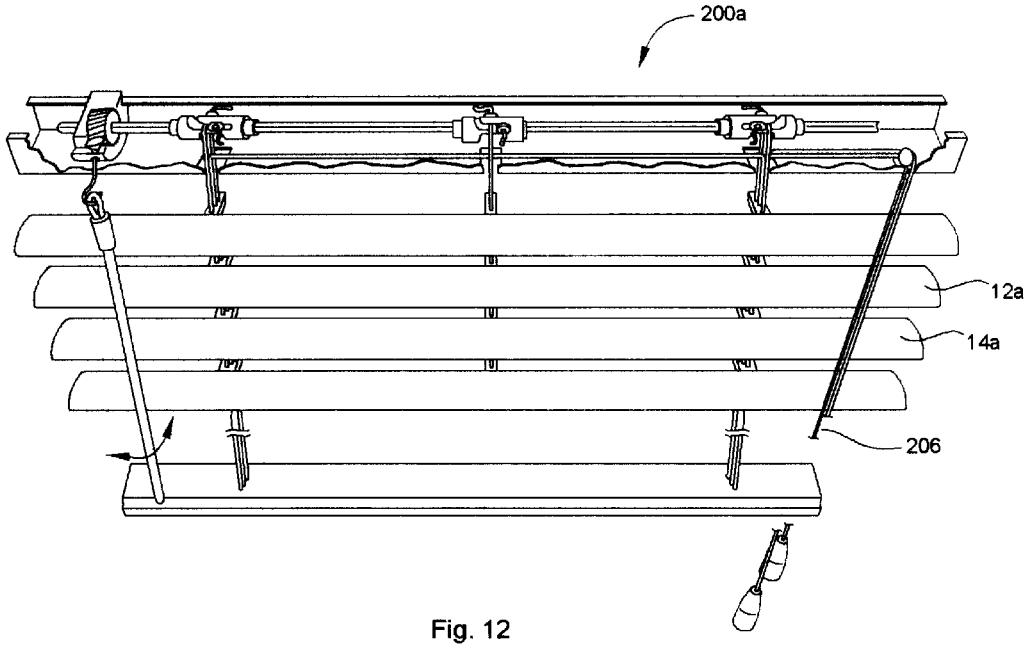
FIG. 12 is a perspective view of a header mechanism according to another embodiment of the invention for adjusting and raising the slats according to the present invention.
Figure 13:
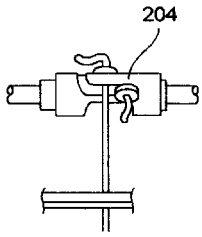
FIG. 13 is a front view showing one of the drums of the header shown in FIG. 12.
Figure 14:
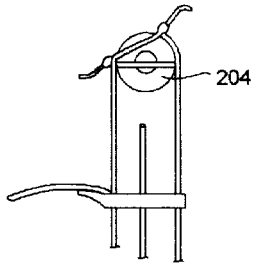
FIG. 14 is a side elevational view the drum shown in FIG. 13.
Figure 15:
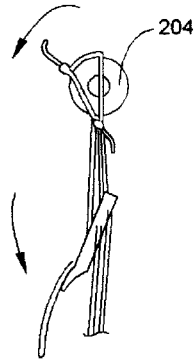
FIG. 15 is a similar view to that shown in FIG. 14 but showing the slats closed.
Figure 16:
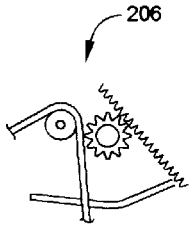
FIG. 16 is a side elevational view showing the lifting mechanism shown in FIG. 12 in the locked disposition.
Figure 17:
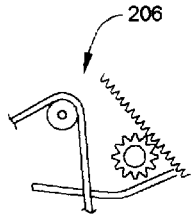
FIG. 17 is a similar view to that shown in FIG. 16 but with the lifting mechanism unlocked.

FIG. 7 is a sectional view of a header 200 for the window blind apparatus 10 shown in FIG. 1;

FIG. 7*a* is a perspective view, on a reduced scale, of the header 200 shown in FIG. 7;

FIG. 8 is a similar view to that shown in FIG. 7 but showing the slats 12 and 14 closed;

FIG. 9 is a perspective view of a mechanism generally designated 202 for lifting and adjusting the window blind apparatus 10 according to the present invention;

FIG. 10 is a side elevational view of the mechanism shown in FIG. 9 with the slat 12 open;

FIG. 11 is a similar view to that shown in FIG. 10 but with the slat 12 closed;

FIG. 12 is a perspective view of a header mechanism generally designated 200*a* according to another embodiment of the invention for adjusting and raising the slats 12*a* and 14*a* according to the present invention;

FIG. 13 is a front view showing one of the drums 204 of the header 200*a* shown in FIG. 12;

FIG. 14 is a side elevational view the drum 204 shown in FIG. 13;

FIG. 15 is a similar view to that shown in FIG. 14 but showing the slats closed;

FIG. 16 is a side elevational view showing the lifting mechanism generally designated 206 shown in FIG. 12 in the locked disposition; and FIG. 17 is a similar view to that shown in FIG. 16 but with the lifting mechanism 206 unlocked.

Figure 18:
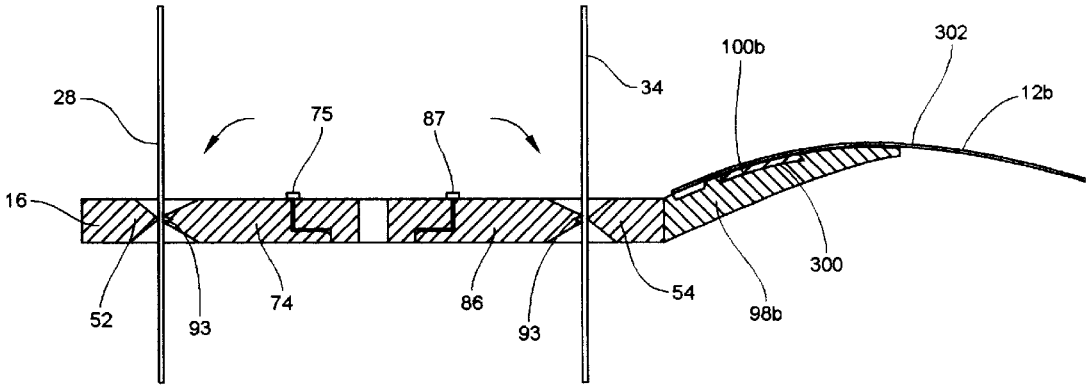
FIG. 18 is a similar view to that shown in FIG. 6 but shows another embodiment of the present invention.

FIG. 18 is a similar view to that shown in FIG. 6 but shows another embodiment of the present invention. As shown in FIG. 18, a slat 12*b* includes a locking member 300 secured to the slat 12*b* which snaps into a socket 100*b* defined by the extension 98*b*. In this manner, the upper surface 302 of the slat 12*b* presents a smooth unbroken contour which farther facilitates cleaning of the slats.

Figure 19:
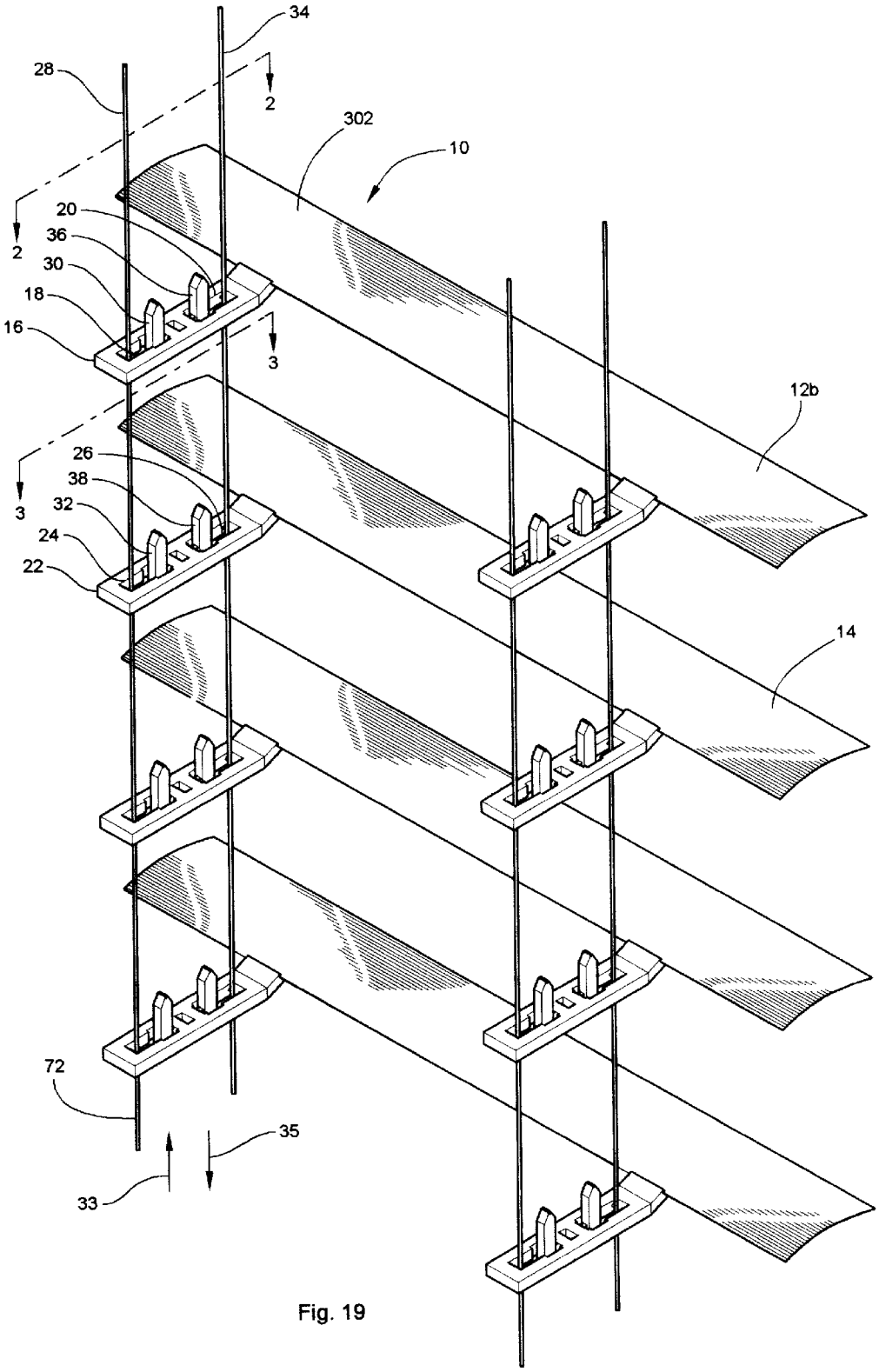
FIG. 19 is a similar view to that shown in FIG. 1 but shows the embodiment of FIG. 18.

FIG. 19 is a similar view to that shown in FIG. 1 but shows the embodiment of FIG. 18. As shown in FIG. 19, the top surface such as 302 of the slat 12*b* is smooth and unbroken. It will be understood by those skilled in the art that the slats can be attached to the extensions in many different ways according to the present invention such as by the application of a double sided tape between the extension and a bottom surface of the slat.

Some of the advantages afforded by the concept of the present invention include simplification of the cleaning process. Also, the blinds according to the present invention block more light because of the absence of holes and the like in the slats. Furthermore, up to 20% less slats are required compared with a typical conventional prior art blind. Additionally, the tabs are not readily visible when the blind is in the closed disposition thereof and the translucent controls further reduce the obstruction of the view through the window when the slats are in the open disposition.

The present invention provides a unique arrangement for supporting horizontal window blind slats so that cleaning thereof is facilitated.

What is claimed is:

1. A horizontal window blind apparatus having at least a first and a second slat disposed parallel and spaced relative to each other, said apparatus comprising:

a first tab secured to the first slat, said first tab defining a first opening and a second opening disposed between said first opening and the first slat;

a second tab secured to the second slat, said second tab being aligned relative to said first tab, said second tab defining a third opening and a fourth opening disposed between said third opening and the second slat;

a first elongate control extending through said first and said third openings;

a first locking device for selectively locking said first control relative to said first tab;

a second locking device for selectively locking said first control relative to said second tab;

a second elongate control extending through said second and said fourth openings;

a third locking device for selectively locking said second control relative to said first tab; and a fourth locking device for selectively locking said second control relative to said second tab, the arrangement being such that relative movement between said first and second control tilts the slats relative to each other so that the slats move between a first disposition thereof in which the slats are open and a second disposition thereof in which the slats are closed.

2. A horizontal window blind apparatus as set forth in claim 1 wherein said first opening is a first hole extending through said first tab, said first hole having a first and a second end;

said second opening is a second hole extending through said first tab, said second hole having a first and a second extremity.

3. A horizontal window blind apparatus as set forth in claim 2 wherein said first tab further defines a nose which is disposed adjacent to said first end of said first hole;

said first tab further defines a further nose which is disposed adjacent to said first extremity of said second hole.

4. A horizontal window blind apparatus as set forth in claim 3 wherein said third opening is a third hole extending through said second tab, said third hole having a first and a second end;

said fourth opening is a fourth hole extending through said second tab, said fourth hole having a first and a second extremity.

5. A horizontal window blind apparatus as set forth in claim 4 wherein said second tab further defines a protrusion which is disposed adjacent to said first end of said third hole;

said second tab further defines a further protrusion which is disposed adjacent to said first extremity of said fourth hole.

6. A horizontal window blind apparatus as set forth in claim 1 wherein said first control is an elongate tape.

7. A horizontal window blind apparatus as set forth in claim 6 wherein said tape is flexible.

8. A horizontal window blind apparatus as set forth in claim 6 wherein said tape is translucent.

9. A horizontal window blind apparatus as set forth in claim 6 wherein said tape is fabricated from a polyester film.

10. A horizontal window blind apparatus as set forth in claim 1 wherein said first locking device includes:

a first block having a first and a second side, said first side selectively engaging said first control when said first block is wedged into said first opening;

said second locking device includes:

a second block having a first and a second edge, said first edge selectively engaging said first control when said second block is wedged into said third opening;

said third locking device includes:

a third block having a first and a second face, said first face selectively engaging said second control when said third block is wedged into said second opening;

said fourth locking device includes:

a fourth block having a first and a second termination, said first termination selectively engaging said second control when said fourth block is wedged into said fourth opening.

11. A horizontal window blind apparatus as set forth in claim 10 wherein said second side of said first block is hingedly secured to said first tab;

said second edge of said second block is hingedly secured to said second tab;

said second face of said third block is hingedly secured to said first tab;

said second termination of said fourth block is hingedly secured to said second tab.

12. A horizontal window blind apparatus as set forth in claim 11 wherein said first and third blocks are integrally molded with said first tab;

said second and fourth blocks are integrally molded with said second tab.

13. A horizontal window blind apparatus as set forth in claim 11 wherein said first opening is a first hole extending through said first tab, said first hole having a first and a second end;

said second opening is a second hole extending through said first tab, said second hole having a first and a second extremity;

said first tab further defining a nose which is disposed adjacent to said first end of said first hole;

said first tab further defining a further nose which is disposed adjacent to said first extremity of said second hole;

said third opening is a third hole extending through said second tab, said third hole having a first and a second end;

said fourth opening is a fourth hole extending through said second tab, said fourth hole having a first and a second extremity;

said second tab further defining a protrusion which is disposed adjacent to said first end of said third hole;

said second tab further defining a further protrusion which is disposed adjacent to said first extremity of said fourth hole, the arrangement being such that said first control is locked relative to said first and second tabs by an interaction between said first side of said first block and said nose and an interaction between said first edge of said second block and said protrusion, the arrangement also being such that said second control is locked relative to said first and second tabs by an interaction between said first face of said third block and said further nose and by an interaction between said first termination of said fourth block and said further protrusion.

14. A horizontal window blind apparatus as set forth in claim 1 wherein said first tab includes an extension for securing said first tab to the first slat;

said extension defining a socket for the retention therein of the first slat;

said second tab includes a further extension for securing said second tab to the second slat;

said further extension defining a further socket for the retention therein of the second slat.

15. A horizontal window blind apparatus having at least a first and a second slat disposed parallel and spaced relative to each other, said apparatus comprising:

a first tab secured to the first slat, said first tab defining a first opening and a second opening disposed between said first opening and the first slat;

a second tab secured to the second slat, said second tab being aligned relative to said first tab, said second tab defining a third opening and a fourth opening disposed between said third opening and the second slat;

a first flexible tape extending through said first and said third openings;

a first locking device for selectively locking said first tape relative to said first tab;

a second locking device for selectively locking said first tape relative to said second tab;

a second flexible tape extending through said second and said fourth openings;

a third locking device for selectively locking said second tape relative to said first tab; and a fourth locking device for selectively locking said second tape relative to said second tab, the arrangement being such that relative movement between said first and second tapes tilts the slats relative to each other so that the slats move between a first disposition thereof in which the slats are open and a second disposition thereof in which the slats are closed.

16. A horizontal window blind apparatus having at least a first and a second slat disposed parallel and spaced relative to each other, said apparatus comprising:

a first tab secured to the first slat, said first tab defining a first opening and a second opening disposed between said first opening and the first slat;

a second tab secured to the second slat, said second tab being aligned relative to said first tab, said second tab defining a third opening and a fourth opening disposed between said third opening and the second slat;

a first translucent tape extending through said first and said third openings;

a first locking device for selectively locking said first tape relative to said first tab;

a second locking device for selectively locking said first tape relative to said second tab;

a second translucent tape extending through said second and said fourth openings;

a third locking device for selectively locking said second tape relative to said first tab; and a fourth locking device for selectively locking said second tape relative to said second tab, the arrangement being such that relative movement between said first and second tapes tilts the slats relative to each other so that the slats move between a first disposition thereof in which the slats are open and a second disposition thereof in which the slats are closed.

* * * * *